US011578933B2

(12) United States Patent
Song

(10) Patent No.: US 11,578,933 B2
(45) Date of Patent: Feb. 14, 2023

(54) FIREARM FRAME AND A METHOD OF MANUFACTURING IT

(71) Applicant: Tingwu Song, Palos Verdes, CA (US)

(72) Inventor: Tingwu Song, Palos Verdes, CA (US)

( * ) Notice: Subject to any disclaimer, the term of this patent is extended or adjusted under 35 U.S.C. 154(b) by 151 days.

(21) Appl. No.: 16/059,310

(22) Filed: Aug. 9, 2018

(65) Prior Publication Data

US 2019/0049203 A1 Feb. 14, 2019

Related U.S. Application Data

(60) Provisional application No. 62/543,634, filed on Aug. 10, 2017.

(51) Int. Cl.
*F41A 3/66* (2006.01)

(52) U.S. Cl.
CPC ..... *F41A 3/66* (2013.01)

(58) Field of Classification Search
CPC ..... F41A 3/66; F41C 23/00; F41C 23/18
USPC ..... 42/71.01
See application file for complete search history.

(56) References Cited

U.S. PATENT DOCUMENTS 5,615,508 A * 4/1997 Miller ..... F41C 23/18 42/71.01
5,797,207 A * 8/1998 Marable ..... B29C 39/10 42/71.02
5,864,978 A * 2/1999 McRary ..... F41C 23/00 264/273
6,070,354 A * 6/2000 Burigana ..... F41C 23/18 42/71.01
6,301,817 B1 * 10/2001 Hogue ..... F41C 23/18 42/71.01
6,427,372 B1 * 8/2002 Howard ..... F41C 23/00 42/71.01
6,557,289 B2 * 5/2003 Stall ..... C22C 21/10 42/71.02
6,711,819 B2 * 3/2004 Stall ..... C22C 21/10 29/898.14
6,964,123 B2 * 11/2005 Vicale ..... F41C 3/00 42/106
7,010,878 B1 * 3/2006 du Plessis ..... F41A 19/10 42/69.01
7,926,217 B2 * 4/2011 McCann ..... F41C 23/16 42/75.03
9,970,724 B1 * 5/2018 Acker ..... F41A 17/46
2001/0054247 A1 * 12/2001 Stall ..... F41C 23/18 42/106
2004/0010917 A1 * 1/2004 Stall ..... F41C 23/00 29/898.14
2004/0211104 A1 * 10/2004 Eberle ..... F41C 23/00 42/71.02
2007/0113459 A1 * 5/2007 Stout ..... F41C 23/18 42/71.01
2010/0162608 A1 * 7/2010 McCann ..... F41C 23/16 42/71.01
2010/0307042 A1 * 12/2010 Jarboe ..... F41A 3/18 42/6

(Continued)

*Primary Examiner* — Michelle Clement

(57) ABSTRACT

A receiver and a method for manufacturing it are disclosed. The receiver contains a first material at least partially surrounded by a second material, wherein the first material has a first melting and the second material has a second melting point, wherein the first melting point is lower than the second melting point. The method disclosed teaches how to manufacture the receiver.

3 Claims, 9 Drawing Sheets

(56) References Cited

U.S. PATENT DOCUMENTS

| | | | | |
|---|---|---|---|---|
| 2012/0017481 | A1* | 1/2012 | Settles | F41A 17/00 42/25 |
| 2012/0144715 | A1* | 6/2012 | Simpson | F41C 23/20 42/74 |
| 2013/0232841 | A1* | 9/2013 | Knoebel | F41C 23/00 42/71.01 |
| 2014/0033589 | A1* | 2/2014 | King, Jr. | B22D 21/04 42/75.01 |
| 2014/0230298 | A1* | 8/2014 | King, Jr. | B23P 15/00 42/16 |
| 2015/0000171 | A1* | 1/2015 | Roberts | F41C 23/06 42/75.03 |
| 2019/0049203 | A1* | 2/2019 | Song | F41A 3/66 |

* cited by examiner

FIREARM FRAME AND A METHOD OF MANUFACTURING IT

CROSS REFERENCE TO RELATED APPLICATIONS

This application claims the benefit of U.S. Provisional Application No. 62/543,634, filed on Aug. 10, 2017, which is incorporated herein by reference in its entirety.

FIELD

The present invention relates to firearm manufacture. More particularly, the present invention relates to a firearm frame and a method of manufacturing it.

BACKGROUND

Firearm frame/receiver is a part of a firearm that provides housing for a hammer, a bolt and/or a firing mechanism. Unfinished frames/receivers, also referred to as 80% frames/receivers, are only about 80% completed. It is up to a customer to finish manufacturing a firearm by performing the remaining 20% of the drilling and/or milling. Due to complexities involved, many customers do not have the equipment and/or knowledge to properly manufacture the last 20% of the firearm frame/receiver.

Therefore, there is a need for a firearm frame/receiver and a method of manufacturing it such that a customer can easily finish manufacturing the last 20% of the firearm.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 1:
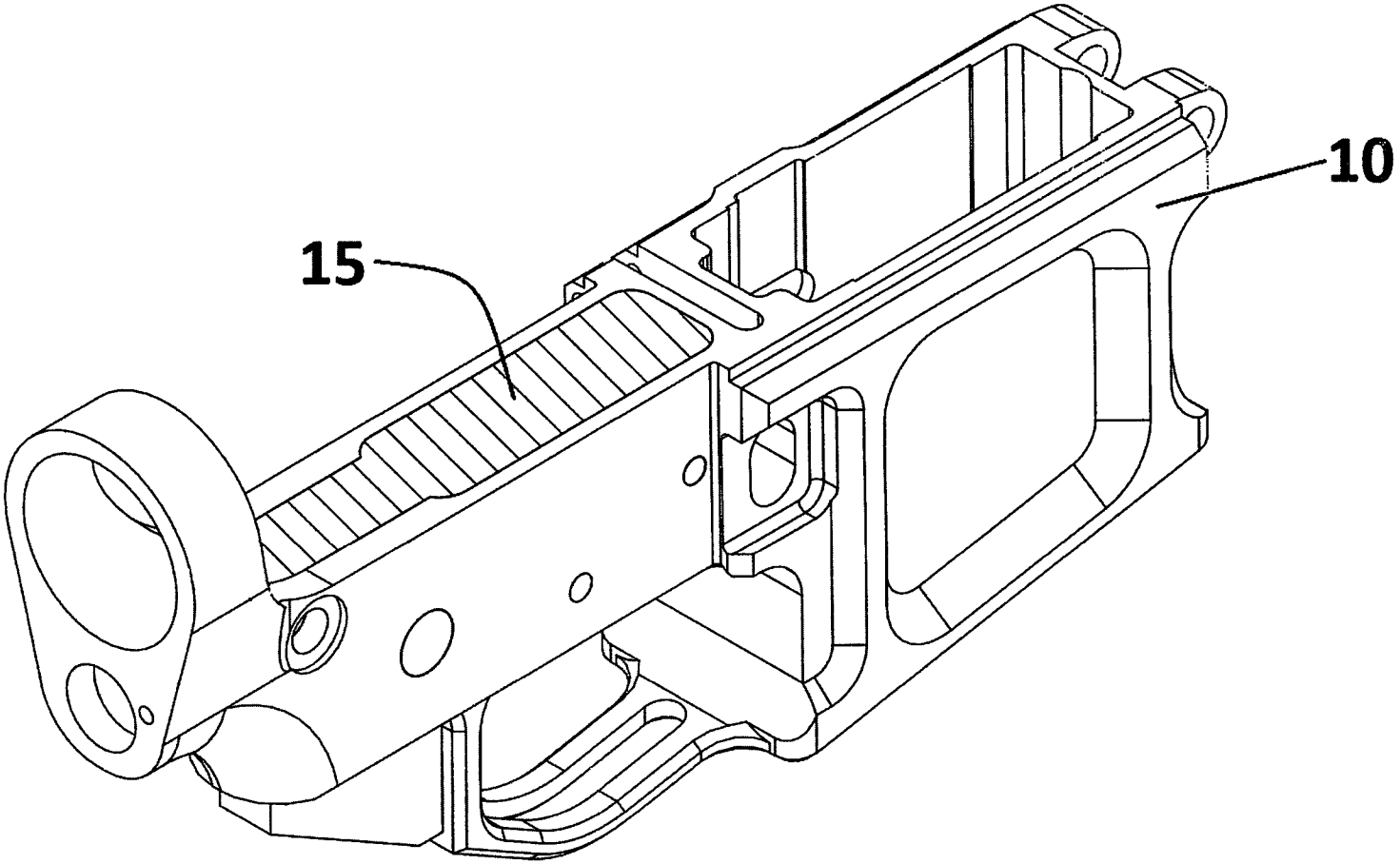
FIG. 1 depicts a receiver according to the present disclosure.
Figure 2:
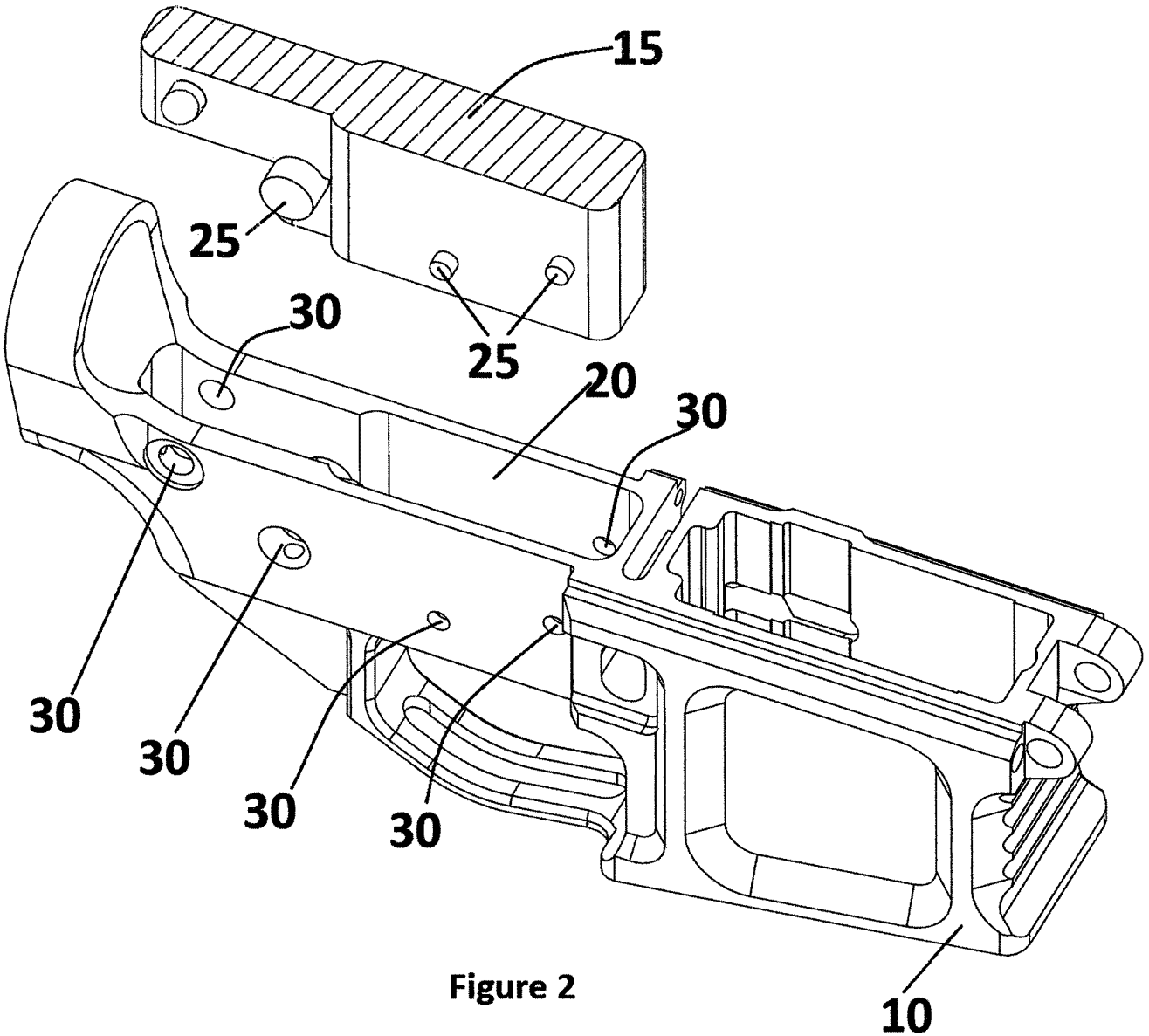
FIG. 2 depicts an exploded view of the receiver in FIG. 1.

Referring to FIGS. 1-2, an 80% receiver/frame 10 for a firearm is shown according to the present disclosure. The 80% receiver 10 comprises an insert 15 at least partially filling a cavity 20 (shown in FIG. 2). The cavity 20 is configured to house a firing mechanism (i.e. trigger group). According to some embodiments presently disclosed, the insert 15 completely fills the cavity 20. It is to be understood that the receiver 10 may be an AR-style lower receiver or any other type of a firearm receiver.

According to some embodiments presently disclosed, the insert 15 comprises a first material having a first melting point and the receiver 10 comprises a second material having a second melting point.

According to some embodiments presently disclosed, the first material is steel, aluminum, metal, polymer, and/or sintered metal powder. According to some embodiments presently disclosed, the second material is steel, aluminum, metal, polymer, and/or sintered metal powder. According to some embodiments presently disclosed, the first melting point is lower than the second melting point.

Figure 3:
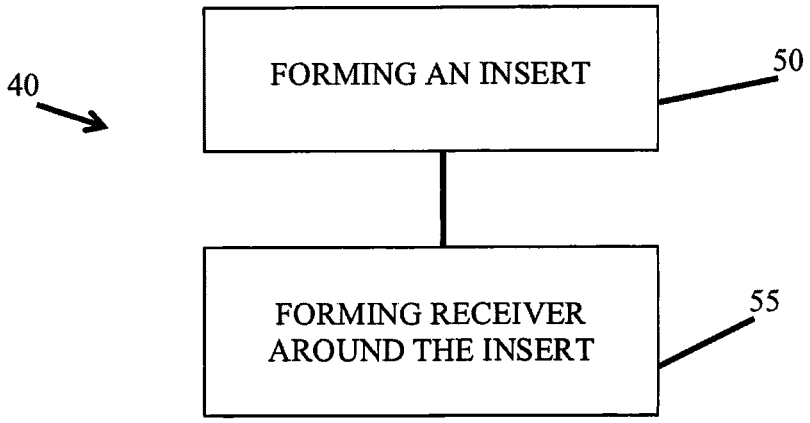
FIG. 3 depicts a method of manufacturing the receiver in FIG. 1.

According to some embodiments, the first material comprises a low density polyethylene with a melting point of about 200° F. and the second material comprises glass filled nylon material with a melting point above 200° F. Referring to FIG. 3, a method 40 of manufacturing the 80% receiver 10 is shown according to the present disclosure. At 50, forming the insert 15. The insert 15 may be machined, stamped or molded. The insert 15 may comprise one or more protrusions 25. At 55, forming the receiver 10 around the insert 15. According to some embodiments, the insert 15 is at least partially covered by the receiver 10. According to some embodiments, the receiver 10 is formed around the insert 15 using, for example, an overmold process.

Figure 4:
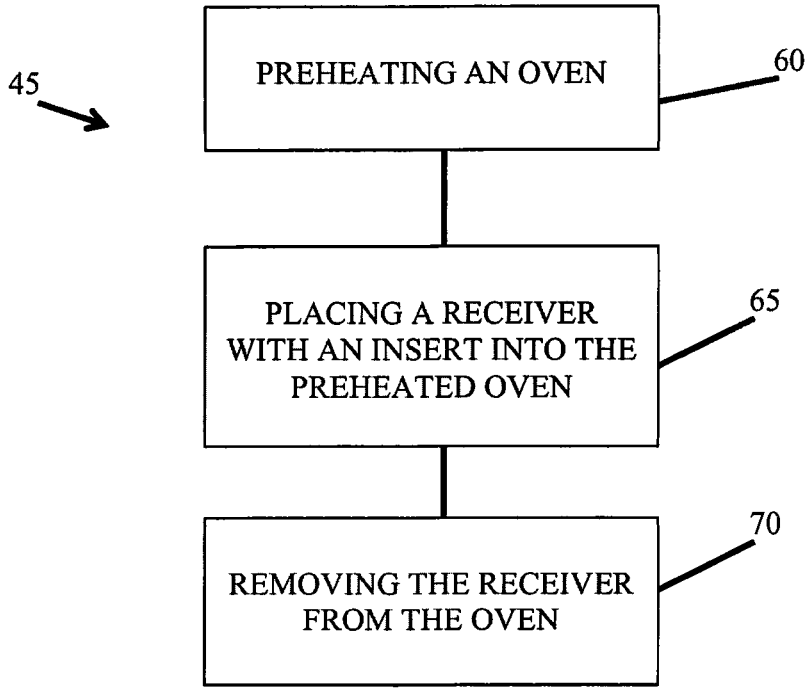
FIG. 4 depicts a method of removing at least a portion of an insert from the receiver in FIG. 1.

Referring to FIG. 4, a method 45 of removing the insert 15 from the receiver 10 is shown according to the present disclosure. At 60, an oven is preheated to a first temperature. According to some embodiments, the first temperature is between the first melting point and a second melting point. The oven may be a common household oven used for cooking food. At 65, the receiver 10 with the insert 15 are placed into the preheated oven for a first period of time. The first period of time is time required for at least a portion of the insert 15 to melt away from the receiver 10 and to form the cavity 20. According to some embodiments presently disclosed, the first period of time is time required for most of the insert 15 to melt away from the receiver 10 and to form the cavity 20. At 70, the receiver 10 is removed from the oven and allowed to cool down. According to some embodiments, a firing mechanism (not shown) may be inserted into the cavity 20 after the receiver 10 is removed from the oven and is allowed to cool down.

According to some embodiments, melting away of the at least a portion of the insert 15 reveals one or more openings 30 through the sidewalls of the receiver 10 as shown in FIG. 2. The one or more openings 30 may be formed by the one or more protrusions 25. The one or more openings 30 may allow for installation of pins (not shown) used to secure the firing mechanism (not shown) in the cavity 20. The one or more openings 30 may be used for mounting a selector (not shown) that enables a user to engage and disengage the safety of the firearm. The one or more openings 30 may allow for installation of at least one pin (not shown) used for coupling an upper receiver (not shown) to the receiver 10.

Figure 5:
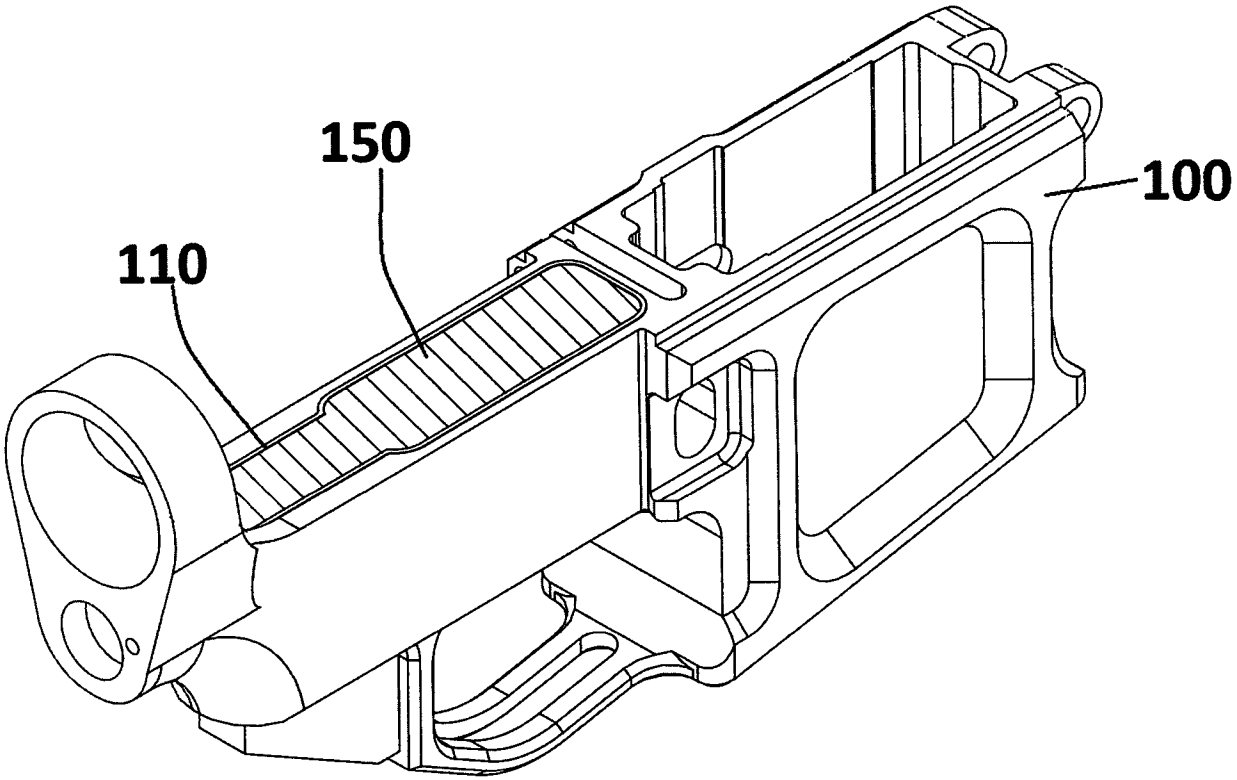
FIG. 5 depicts another receiver according to the present disclosure.
Figure 6:
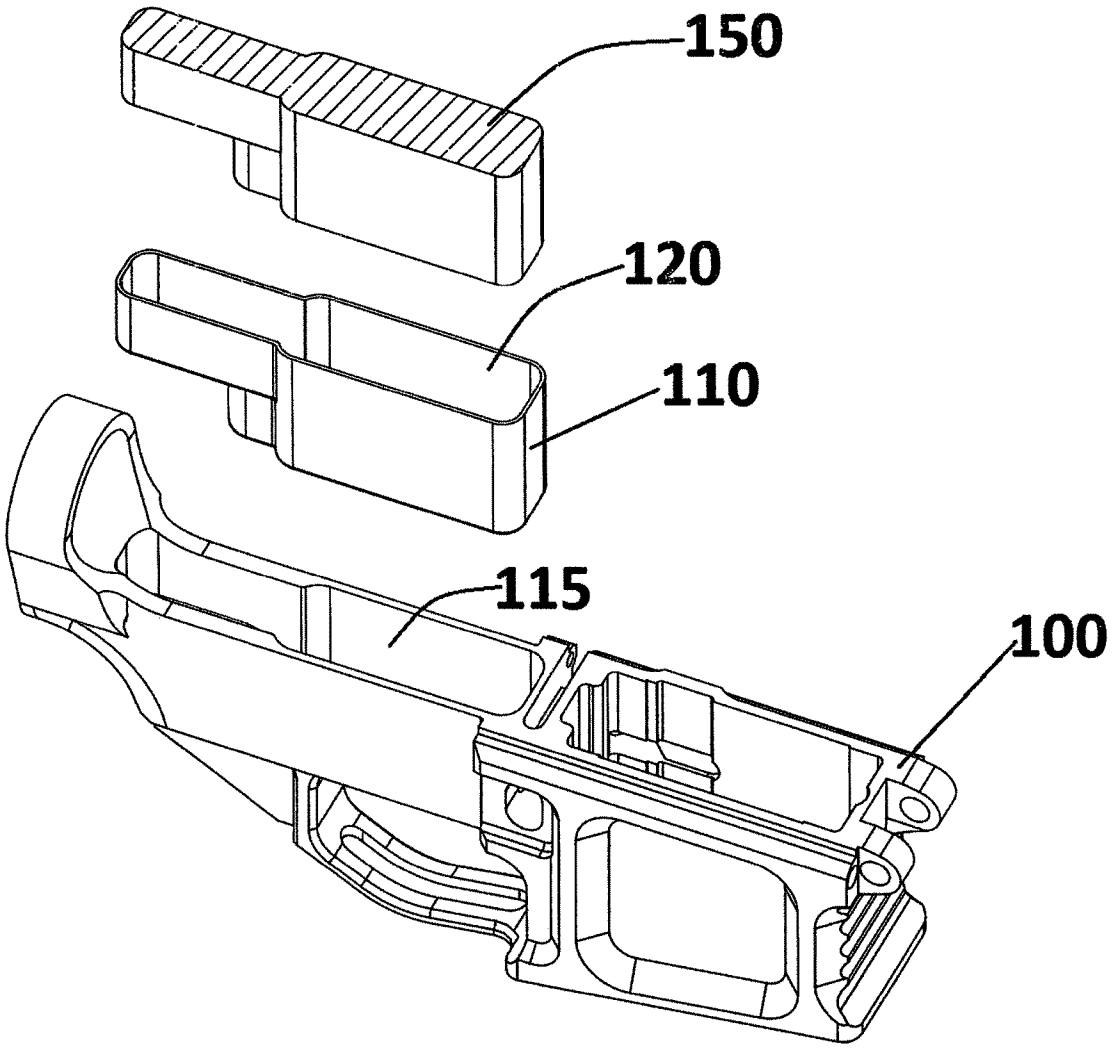
FIG. 6 depicts an exploded view of the receiver in FIG. 5.

Referring to FIGS. 5-6, an 80% receiver 100 for a firearm is shown according to the present disclosure. The 80% receiver 100 comprises an insert cover 110 and an insert 150 at least partially covered by the insert cover 110 (shown in FIGS. 5-6). The receiver 100 comprises a receiver cavity 115 for housing the insert cover 110. The insert cover 110 forms a insert cover cavity 120 for housing a firing mechanism (i.e. trigger group). According to some embodiments presently disclosed, the insert 150 completely fills the insert cover cavity 120. It is to be understood that the receiver 100 may be an AR-style lower receiver or any other type of a firearm receiver.

According to some embodiments presently disclosed, the insert 150 comprises a first material having a first melting point, the receiver 100 comprises a second material having a second melting point, and the insert cover 110 comprises a third material having a third melting point.

According to some embodiments presently disclosed, the first material is steel, aluminum, metal, polymer, and sintered metal powder. According to some embodiments presently disclosed, the second material is steel, aluminum, metal, polymer, and sintered metal powder. According to some embodiments presently disclosed, the third material is steel, aluminum, metal, polymer, and/or sintered metal powder. According to some embodiments presently disclosed, the first melting point is lower than the second melting point. According to some embodiments presently disclosed, the first melting point is lower than the third melting point. According to some embodiments presently disclosed, the first melting point is lower than the second melting point and the third melting point.

According to some embodiments, the first material comprises a low density polyethylene with a melting point of about 200° F., the second material comprises glass filled nylon material with a melting point above 200° F., and the third material is metal with a melting point above 200° F.

Figure 7:
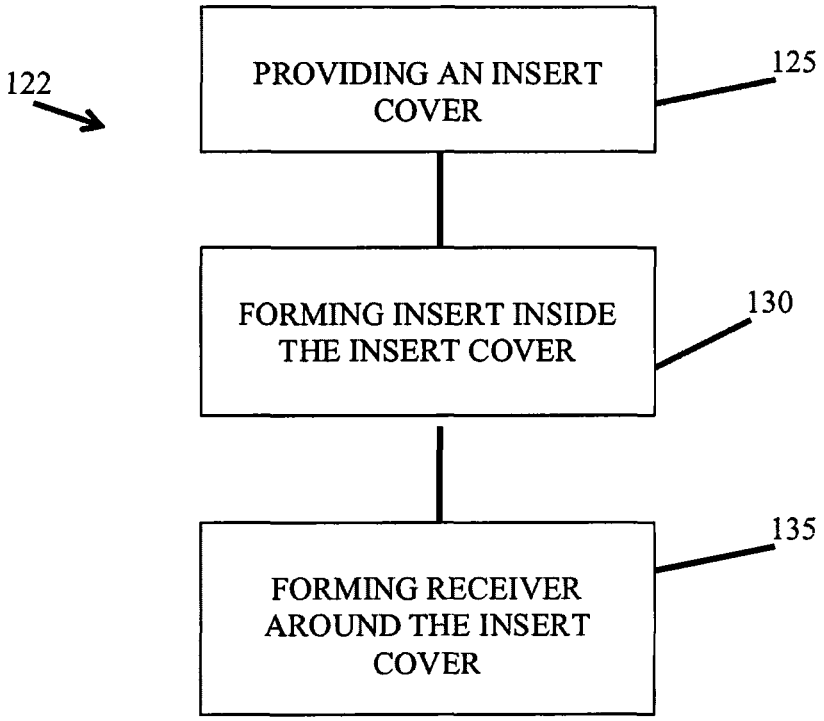
FIG. 7 depicts a method of manufacturing the receiver in FIG. 5.

Referring to FIG. 7, a method 122 of manufacturing the 80% receiver 100 is shown according to the present disclosure. At 125, providing the insert cover 110. The insert cover 110 may be machined, stamped or molded. At 130, forming the insert 150 inside the insert cover 110. According to some embodiments, the insert 150 is at least partially covered by the insert cover 110. The insert 150 may be molded. At 135, forming the receiver 100 around the insert cover 110. According to some embodiments, the receiver 100 is formed around the insert cover 110 using, for example, an overmold process.

Figure 8:
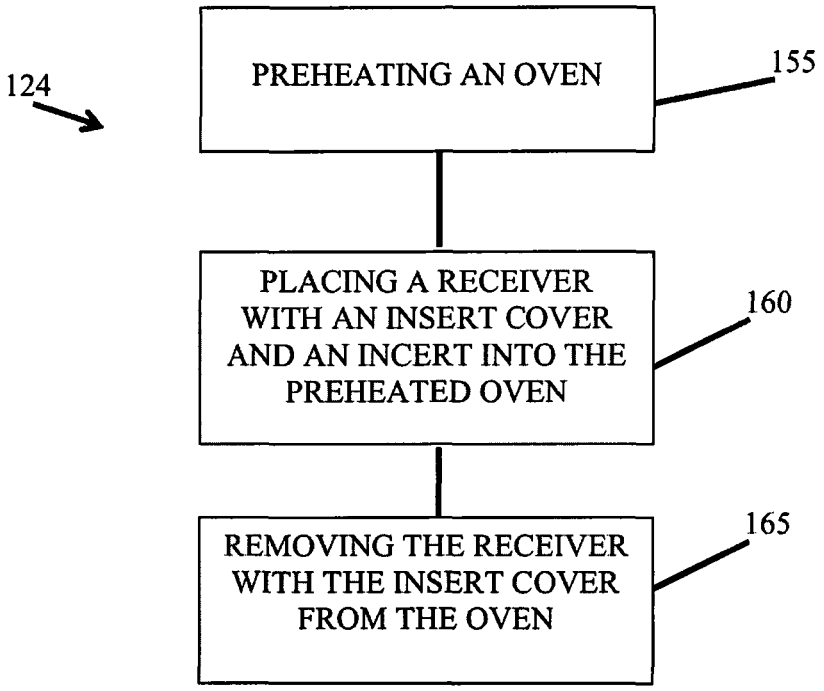
FIG. 8 depicts a method of removing at least a portion of an insert from the receiver in FIG. 5.

Referring to FIG. 8, a method 124 of removing the insert 150 from the insert cover 110 is shown according to the present disclosure. At 155, an oven is preheated to a first temperature. According to some embodiments, the first temperature is above the first melting point, below the second melting point, and below the third melting point. The oven may be a common household oven used for cooking food. At 160, the receiver 100 with the insert cover 110 and the insert 150 are placed into the preheated oven for a first period of time. The first period of time is time required for at least a portion of the insert 150 to melt away from the insert cover 110 and to form the cavity 120. According to some embodiments presently disclosed, the first period of time is time required for most of the insert 150 to melt away from the insert cover 110 and to form the cavity 120. At 165, the receiver 100 and the insert cover 110 are removed from the oven and allowed to cool down. According to some embodiments, a firing mechanism (not shown) may be inserted into the cavity 120 after the receiver 100 is removed from the oven and is allowed to cool down.

According to some embodiments, one or more openings (not shown) may be formed through the sidewalls of the receiver 100 and the insert cover 110. The one or more openings (not shown) may be formed to allow for installation of pins (not shown) used to secure the firing mechanism (not shown) in the cavity 120. The one or more openings may be used for mounting a selector (not shown) that enables a user to engage and disengage the safety of the firearm. The one or more openings may allow for installation of at least one pin (not shown) used for coupling an upper receiver (not shown) to the receiver 100.

Figure 9:
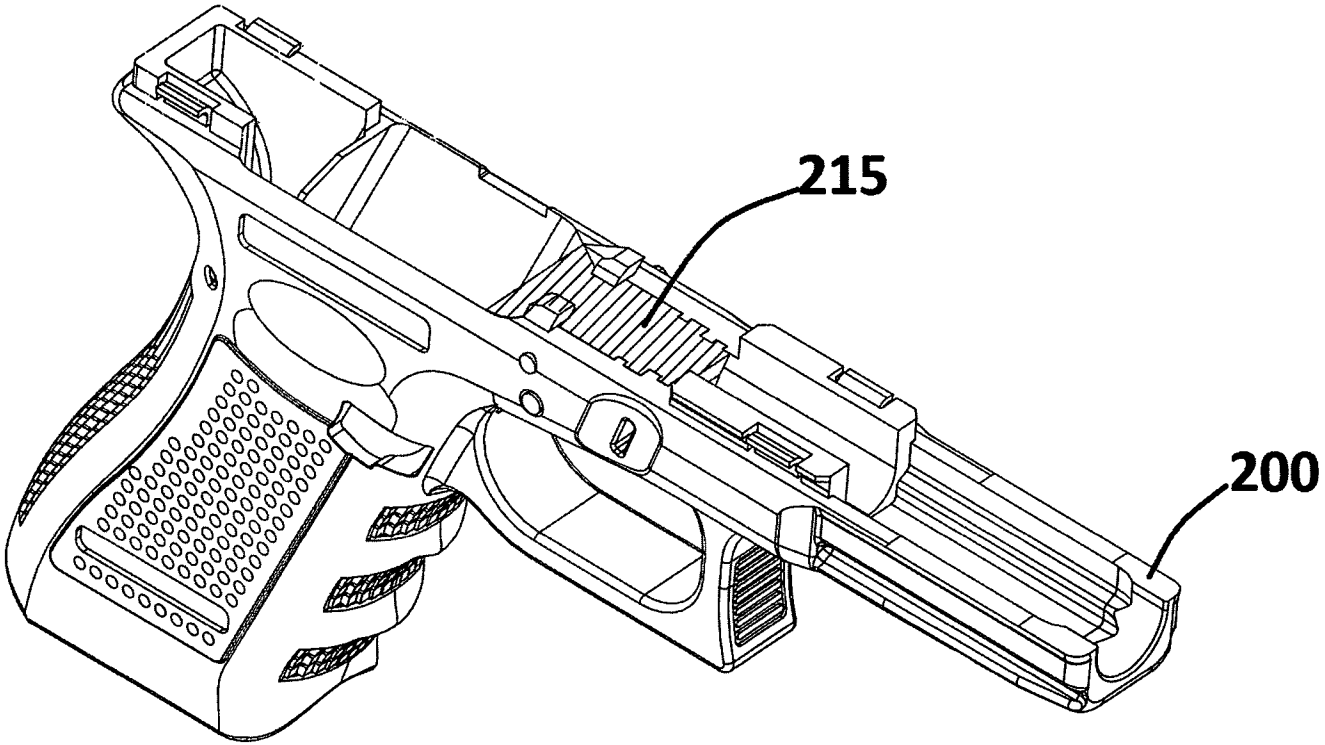
FIG. 9 depicts a frame according to the present disclosure.
Figure 10:
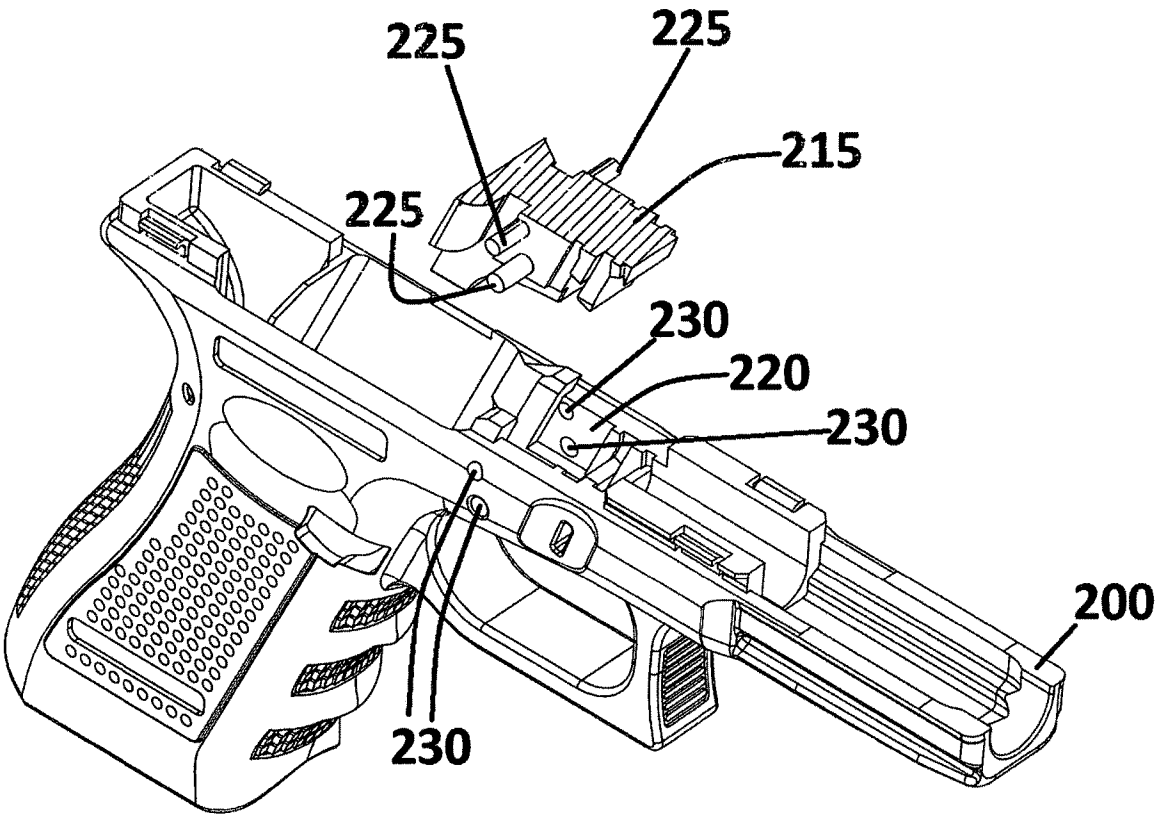
FIG. 10 depicts an exploded view of the frame in FIG. 9.

Referring to FIGS. 9-10, an 80% frame 200 for a firearm is shown according to the present disclosure. The 80% frame 200 comprises an insert 215 at least partially filling a cavity 220 (shown in FIG. 10). The cavity 220 is configured to house a firing mechanism (i.e. trigger group). According to some embodiments presently disclosed, the insert 215 completely fills the cavity 220. It is to be understood that the frame 200 may be a frame for a handgun.

According to some embodiments presently disclosed, the insert 215 comprises a first material having a first melting point and the frame 200 comprises a second material having a second melting point.

According to some embodiments presently disclosed, the first material is steel, aluminum, metal, polymer, and/or sintered metal powder. According to some embodiments presently disclosed, the second material is steel, aluminum, metal, polymer, and/or sintered metal powder. According to some embodiments presently disclosed, the first melting point is lower than the second melting point.

Figure 11:
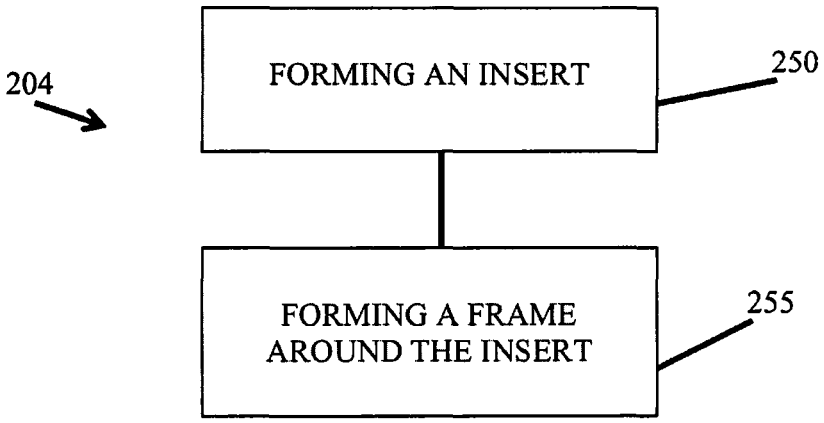
FIG. 11 depicts a method of manufacturing the frame in FIG. 9.

According to some embodiments, the first material comprises a low density polyethylene with a melting point of about 200° F. and the second material comprises glass filled nylon material with a melting point above 200° F. Referring to FIG. 11, a method 204 of manufacturing the 80% frame 200 is shown according to the present disclosure. At 250, forming the insert 215. The insert 215 may be machined, stamped or molded. The insert 215 may comprise one or more protrusions 225. At 255, forming the frame 200 around the insert 215. According to some embodiments, the insert 215 is at least partially covered by the frame 200. According to some embodiments, the frame 200 is formed around the insert 215 using, for example, an overmold process.

Figure 12:
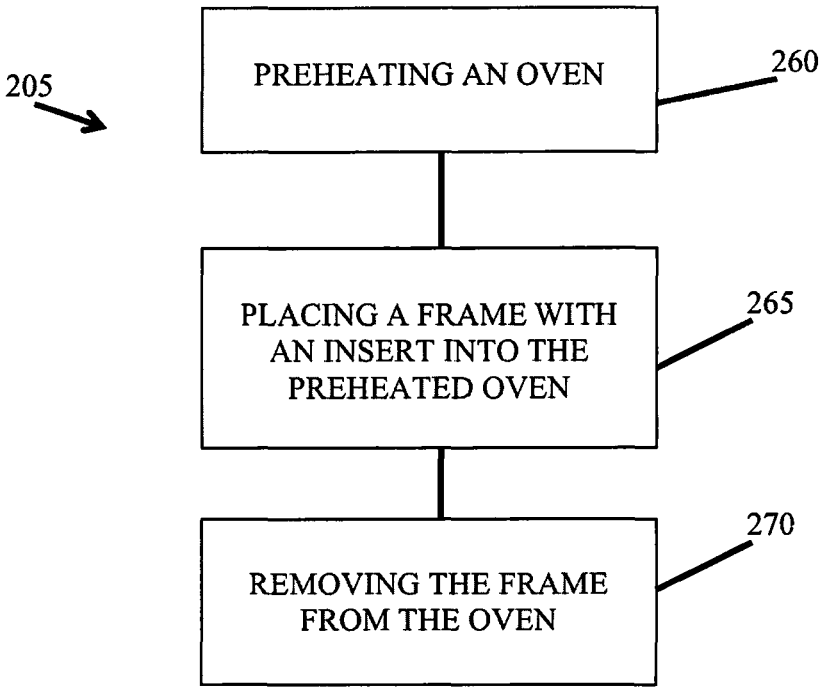
FIG. 12 depicts a method of removing at least a portion of an insert from the frame in FIG. 9.

Referring to FIG. 12, a method 205 of removing the insert 215 from the frame 200 is shown according to the present disclosure. At 260, an oven is preheated to a first temperature. According to some embodiments, the first temperature is between the first melting point and a second melting point. The oven may be a common household oven used for cooking food. At 265, the frame 200 with the insert 215 are placed into the preheated oven for a first period of time. The first period of time is time required for at least a portion of the insert 215 to melt away from the frame 200 and to form the cavity 220. According to some embodiments presently disclosed, the first period of time is time required for most of the insert 15 to melt away from the receiver 10 and to form the cavity 20. At 270, the frame 200 is removed from the oven and allowed to cool down. According to some embodiments, a firing mechanism (not shown) may be inserted into the cavity 220 after the frame 200 is removed from the oven and is allowed to cool down.

According to some embodiments, melting away of the at least a portion of the insert 215 reveals one or more openings 230 through the sidewalls of the frame 200 as shown in FIG. 10. The one or more openings 230 may be formed by the one or more protrusions 225. The one or more openings 230 may allow for installation of pins (not shown) used to secure the firing mechanism (not shown) in the cavity 220.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "step(s) for . . . ."

What is claimed is:

1. A receiver comprising:

a frame comprising a cavity for housing a firing mechanism;

a first material disposed within the cavity and completely filling the cavity, wherein the first material is at least partially surrounded by a second material, wherein the frame comprises the second material;

wherein the first material has a first melting and the second material has a second melting point; wherein the first melting point is lower than the second melting point.

2. The receiver of claim 1 further comprising a third material disposed between the first material and the second material; wherein the third material has a third melting point that is higher that the first melting point.

3. The receiver of claim 2 wherein the third material forms an insert cover.

* * * * *